US005257600A

United States Patent [19]

Schechter et al.

[11] Patent Number: 5,257,600

[45] Date of Patent: Nov. 2, 1993

[54] VARIABLE COMPRESSION PISTON

[75] Inventors: Michael M. Schechter, Farmington Hills; David L. Boggs, West Bloomfield, both of Mich.

[73] Assignee: Ford Motor Company, Dearborn, Mich.

[21] Appl. No.: 1,698

[22] Filed: Jan. 7, 1993

[51] Int. Cl.[5] ..... F02B 75/04

[52] U.S. Cl. ..... 123/78 B

[58] Field of Search ..... 123/78 B, 78 BA, 48 B; 92/60.5

[56] References Cited

U.S. PATENT DOCUMENTS

| | | | |
|---|---|---|---|
| 3,303,831 | 2/1967 | Sherman | 123/48 |
| 3,704,695 | 12/1972 | Cronstedt | 123/78 B |
| 3,777,724 | 12/1973 | Kiley | 123/78 B |
| 3,934,560 | 1/1976 | Dodd | 123/32 B |
| 4,016,841 | 4/1977 | Karaba et al. | 123/78 B |
| 4,079,707 | 3/1978 | Karaba et al. | 123/78 B |
| 4,241,705 | 12/1980 | Karaba et al. | 123/78 B |
| 4,784,093 | 11/1988 | Pfefer et al. | 123/78 B |
| 4,785,790 | 11/1988 | Pfefer et al. | 123/78 B |
| 4,809,650 | 3/1989 | Arai et al. | 123/78 B |
| 4,934,347 | 6/1990 | Suga et al. | 123/78 B |
| 4,979,427 | 12/1990 | Pfefer et al. | 90/60.5 |

OTHER PUBLICATIONS

SAE Technical Paper Series, No. 901539, Variable Compression Pistons, by Cedric Ashley, 1990.

*Primary Examiner*—Noah P. Kamen

*Attorney, Agent, or Firm*—Roger L. May; Jerome R. Drouillard

[57] ABSTRACT

An apparatus for maintaining a consistently high compression ratio in an internal combustion engine utilizing a variable compression piston assembly. The piston having an outer piston mounted on an inner piston with an upper oil chamber therebetween. The piston assembly further having a lower oil chamber below the inner piston and a hydraulic system of valves for feeding oil into and maintaining oil within the oil chambers in response to the pressure within the cylinder.

13 Claims, 3 Drawing Sheets

VARIABLE COMPRESSION PISTON

TECHNICAL FIELD

This invention relates to a variable compression piston adapted for use with an internal combustion engine, and more particularly to a hydraulic control system which regulates the variable compression piston.

BACKGROUND OF INVENTION

In a typical internal combustion engine, a greater efficiency and power output can be achieved by raising the compression ratio of the cylinders to maintain the peak combustion pressure and peak unburned gas temperature. A higher compression ratio can also improve exhaust emissions indirectly. On the other hand, a higher cylinder pressure can create problems with engine knock. The typical engine configuration is, therefore, a compromise between these two limits. In an effort to work around this compromise and achieve significantly higher compression ratios while still avoiding knock, the concept of a variable compression piston has been developed. This design is used to maintain the prescribed peak combustion pressure in a cylinder regardless of varying engine loads.

The typical configurations of prior art variable compression pistons are shown in SAE technical paper "Variable Compression Pistons," Cedric Ashley, SAE technical paper number 901539, 1990. The typical variable compression piston has an outer piston slidably and concentrically mounted on an inner piston which is rotatably mounted on a connecting rod. The reciprocating motion of the inner piston is, therefore, fixed relative to the cylinder, but the outer piston motion can vary due to its ability to move up or down axially relative to the inner piston. The typical variable compression piston also has an upper cavity between the upper surface of the inner piston and the lower surface of the outer piston which is filled with oil from the crankcase; a lower cavity formed between the lower surface of the inner piston and some member fixed to the lower end of the outer piston which is also filled with oil; and a mechanism for transmitting oil into, out of or between the two cavities in response to the current compression ratio in the cylinder.

One such mechanism is a hydraulic system in which an oil supply line runs up through the connecting rod and into the piston pin where it forks into two one way valves, one valve connected to the upper cavity and the other connected to the lower cavity, to supply oil from the crankcase to the system. This hydraulic system also has an orifice located at a point along the bottom of the lower cavity to allow oil to drain back into the crankcase. The system further has two discharge valves connected to the upper cavity, one primary and the other secondary with the secondary discharge valve having a higher spring rate than the primary. The two discharge valves drain the oil back into the crankcase. In this system the primary discharge valve is calibrated to operate the system both at steady state and for increasing or decreasing loads on the engine, while the secondary discharge valve only opens when there is a large increase in the engine load, to more quickly drain oil from the upper cavity.

Several potential problems exist with such a system. First, the orifice in the lower cavity may allow air to enter the system which will have an adverse impact on the system operation since air is compressible. A second potential problem is that the oil supply line has no control over the excess or lack of oil pressure that may occur. If the oil pressure is zero or negative, then the oil may reverse direction and drain out of the oil supply line leaving an inadequate supply of oil for the cavities. This condition may occur when the piston is at bottom dead center. On the other hand, if the oil pressure is too high, the pressure from the supply oil entering the cavities may interfere with the calibration of the opening of the discharge valves leading to an incorrect piston height. This system has no control over the maximum oil pressure that is supplied to the cavities when the piston reaches top dead center.

Another such variable compression piston has a hydraulic system in which an oil supply line runs up through the connecting rod and into the piston pin through a one way valve connected to the upper cavity, to supply oil from the crankcase to the system. This system also has a bore, with an orifice for limiting the rate of flow, through the inner piston connecting the upper oil cavity to the lower oil cavity allowing free flow in both directions and a bore from the upper oil cavity to the lower cavity with a one way valve mounted in it that allows oil to flow from the upper chamber to the lower chamber when the oil pressure in the upper chamber is larger than the oil pressure in the lower chamber by a minimum threshold amount. These two bores allow oil to be supplied to the lower cavity. The system further has a single discharge valve connected to the upper cavity, which discharges oil into the crankcase, with a spring rate calibrated to change the oil volume in the upper chamber based upon the compression pressure. This system further has a one way valve mounted along the oil supply line within the connecting rod which closes when the pressure in the oil line drops below a certain minimum amount in order to prevent the oil from draining out of the supply line and leaving the system without any supply oil.

This system also has several potential problems which exist. First, the bore extending between the upper oil cavity and the lower cavity not only allows free flow of fluid between the two cavities thereby preventing potential cavitation problems in the lower oil cavity, but also allows the high pressures which build up in the upper oil cavity to be transmitted to the lower oil cavity. The net effect is much higher pressures in both cavities since the cross sectional area of the lower face, which sees the pressure, is subtracted from the cross sectional area of the upper face of the upper oil cavity to yield a lesser effective pressure area than the area of the upper face alone. A second problem with this system is its limited ability to discharge oil from the upper oil cavity at a rapid rate should the engine load dramatically increase with only a one discharge valve design. A third problem is similar problem that the first design also has. This system has no way of limiting the maximum oil pressure in the oil supply line that feeds into the upper oil cavity, so again if the pressure reaches too high of a level the calibration of the system can be compromised. A further drawback to both of these prior art configurations and others is that none of them teach a method or develop structure in which the calibration of the discharge valve can be made to cause the compression ratio to increase with increasing engine speed or decrease with decreasing engine speed.

SUMMARY OF INVENTION

The present invention contemplates a variable compression piston with improved characteristics over prior art variable compression pistons due to the configuration of its component parts.

Specifically, the present invention contemplates a variable compression piston for use with an internal combustion engine and to be pivotally connected to an engine connecting rod with an oil supply channel extending through the engine connecting rod. The variable compression piston is comprised of an outer piston and an inner piston concentrically slidably nested within the outer piston and forming an upper oil chamber therebetween, the piston having a central axis. The variable compression piston also has a bottom plate fixed to the outer piston at a point below the inner piston which forms a lower oil chamber therebetween, and an oil filled hydraulic system which includes a one-way transfer valve for transferring the oil from the lower chamber to the upper chamber when the oil pressure in the lower chamber exceeds the oil pressure in the upper chamber by a predetermined amount. The hydraulic system further includes a discharge valve mechanism for discharging oil from the upper oil chamber when the oil pressure in the upper chamber reaches a predetermined amount, and a supply valve mechanism for supplying the upper and lower chambers with oil by communicating with the connecting rod supply channel.

Additionally, the present invention contemplates an internal combustion engine having a variable compression piston slidably installed within an engine cylinder and pivotally connected to an engine connecting rod with an oil supply channel located along the engine connecting rod longitudinal axis. The variable compression piston is comprised of an outer piston and an inner piston concentrically slidably nested within the outer piston and forming an upper oil chamber therebetween, the piston having a central axis. The variable compression piston also has a bottom plate fixed to the outer piston at a point below the inner piston which forms a lower oil chamber between the inner piston and the bottom plate. The variable compression piston also includes an oil filled hydraulic system having a transfer valve mechanism for transferring the oil between the lower chamber and the upper chamber and a supply mechanism for supplying the upper and lower chambers with oil by communicating with the connecting rod supply channel. The hydraulic system further includes a primary valve mechanism for discharging oil from the upper oil chamber thereby lowering the outer piston relative to the inner piston an amount each cycle in order to offset a raising of the outer piston relative to the inner piston which occurs when oil is transferred from the lower oil chamber to the upper oil chamber thereby maintaining a constant compression ratio for a constant engine load, and a second valve mechanism which discharges additional oil from the upper chamber, whenever the engine load increases and causes a resultant increase in cylinder pressure, thereby moving the outer piston downward relative to the inner piston until again reaching the desired compression ratio.

The present invention further contemplates in combination with a reciprocating variable compression piston assembly, a valve assembly located within a bore extending through the piston assembly for allowing fluid to flow from one side of the piston to the other when the valve assembly is open. The valve system is comprised of a valve body retained within the piston assembly having a spring chamber and annulus about the periphery with a valve portion mounted within the valve body having a spring seat. The valve system also has a spring mounted within the valve body pressing against a spring seat, which biases the valve in the closed position. The valve portion includes a cylindrical guiding cylinder slidably engaging the valve body with virtually no clearance therebetween and butting against the spring seat; a conical tip which seats against the outlet of the valve body; and a lower shank portion therebetween of a smaller diameter than the guiding cylinder and located adjacent to the annulus in the valve body when the valve is in its closed position.

The discharge valve is calibrated according to the following equation:

$$F=P_1(A_1/A_2)A_3-M_1aA_3/A_2+M_3a\cos\Theta,$$

where $F$=The primary discharge valve opening force, $P_1$=The pressure in the engine cylinder, $A_1$=The outer piston area on its upper surface, $A_2$=The inner piston area on its upper surface, $A_3$=The discharge valve pressure area, $M_1$=The mass of the outer piston, $M_3$=The mass of the valve portion within the discharge valve, $a$=The acceleration of the piston parallel with the piston axis, and $\Theta$=The angle between the movement of the valve portion and the cylinder axis, the angle between 0 and 90 degrees; and wherein the valve is calibrated such that $(M_3/A_3)\cos\Theta<M_1/A_2$ will produce a compression ratio which increases with increasing engine speed, and $(M_3/A_3)\cos\Theta>M_1/A_2$ produces a compression ratio which decreases with increasing engine speed.

These and other objects are achieved by applicant's invention as shown in the attached drawings and described below.

BEST MODE FOR CARRYING OUT THE INVENTION

Figure 1:
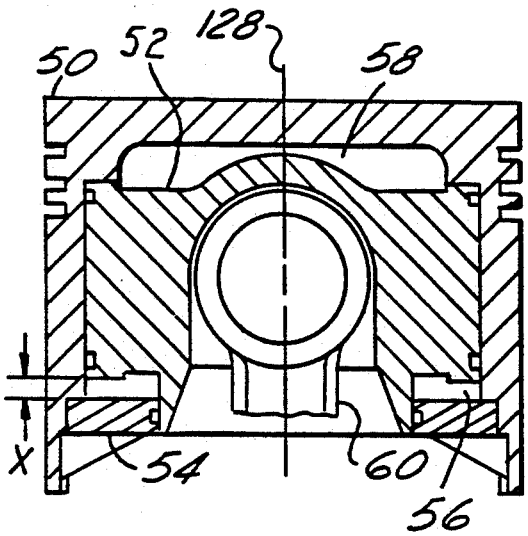
FIG. 1 is a cross-sectional side view of a variable compression piston in accordance with the present invention.
Figure 2:
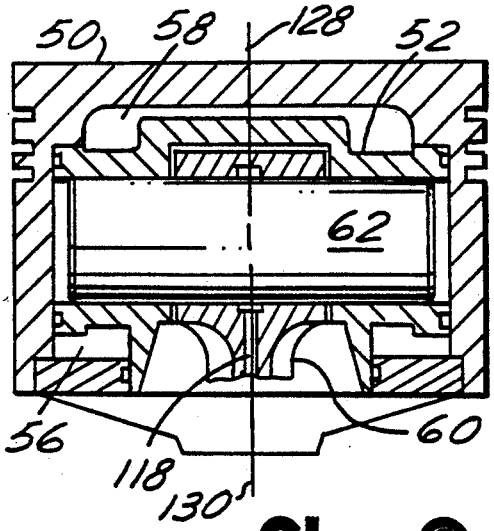
FIG. 2 is a view similar to FIG. 1 rotated 90° to show further detail, in accordance with the present invention.

FIGS. 1 and 2 show the overall arrangement of the piston assembly. The two main components of the assembly are an outer piston 50, and an inner piston 52. A bottom plate 54 is attached to the outer piston 50. The volume between the bottom plate 54 and the inner piston 52 forms the lower oil chamber 56. The volume between the inner piston 52 and the top of the outer piston 50 forms the upper oil chamber 58. Both the lower and the upper oil chambers are filled with oil.

The connecting rod 60 and the piston pin 62 are connected to the inner piston 52 and, thus, inner piston 52 position at the top dead center is always the same. The outer piston 50 can move, within limits, up or down, in a direction parallel to the cylinder control axis 128, relative to the inner piston 52, provided a suitable flow of oil into and out of the upper and lower chambers 56, 58 is permitted. In FIGS. 1 and 2, the outer piston 50 is shown in its lowest position relative to the inner piston 52. It can move upward a maximum distance "X" to its highest position or occupy any intermediate position. Varying the position of the outer piston 50 relative to the inner piston 52 changes the volume of the combustion chamber at top dead center and, thus, varies the engine compression ratio.

During engine operation, the outer piston 50 is subjected to a combination of vertical forces parallel to the cylinder central axis 128, which include the cylinder gas pressure force, the hydraulic force, and the inertial force. The net vertical force acting on the outer piston 50 varies its magnitude and direction throughout each engine cycle. The inner piston 52 contains a system of hydraulic valves and passages which control the flow of oil into and out of the chambers 56, 58 and, thus, control the relative motion of the outer piston 50 by taking advantage of the net vertical force.

Figure 3:
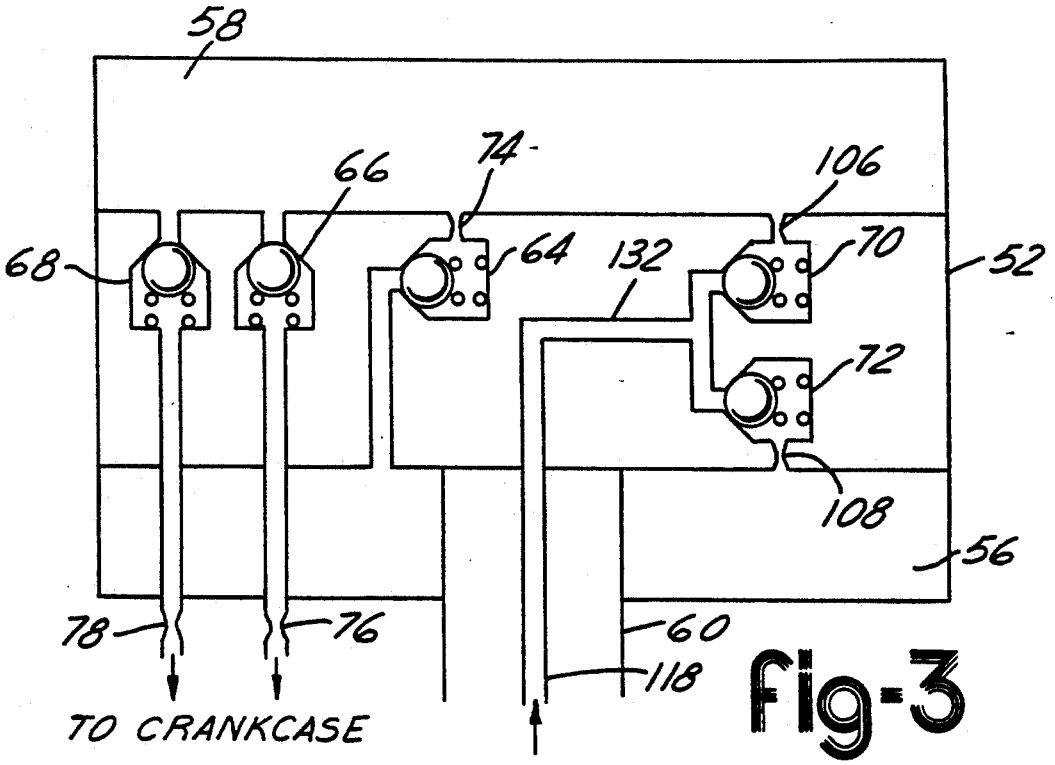
FIG. 3 is a schematic diagram of the hydraulic system within the variable compression piston, in accordance with the present invention.

FIG. 3 illustrates a schematic of the hydraulic system inside the inner piston 52. The hydraulic system includes a transfer valve 64, a primary discharge valve 66, a secondary discharge valve 68, an upper refill valve 70 and a lower refill valve 72. It should be noted that the discharge valves 66, 68 are substantially different in construction and operation from the transfer valve 64 and the refill valves 70, 72, but are shown schematically here as simple valves. The hydraulic system also includes a transfer orifice 74, primary and secondary discharge orifices 76, 78 respectively, an upper refill valve orifice 106 and a lower refill valve orifice 108. Oil is supplied to the system through a channel 118 located inside the connecting rod 60 along the longitudinal axis 130 of the connecting rod 60, through a bore 132 in the center of the piston pin 62, and then through passages in the inner piston 52. The transfer valve 64 and both the upper and lower refill valves 70, 72 are one-way valves set to open at very low pressure differentials. The transfer valve 64 allows oil to flow only from the lower oil chamber 56 to the upper oil chamber 58. The upper and lower refill valves 70, 72 allow oil to flow only from the oil supply channel 118 into the upper and lower oil chambers 58, 56, respectively. To eliminate the influence of inertial force due to the reciprocating motion of the piston, the opening and closing motions of the valves 64, 70 and 72 are oriented in a direction normal to the cylinder axis 128. The primary and secondary discharge valves 66, 68 are pressure-actuated one-way valves set to open at high pressure differentials. The opening pressure of the secondary discharge valve 68 is higher than the opening pressure of the primary discharge valve 66.

Figure 4:
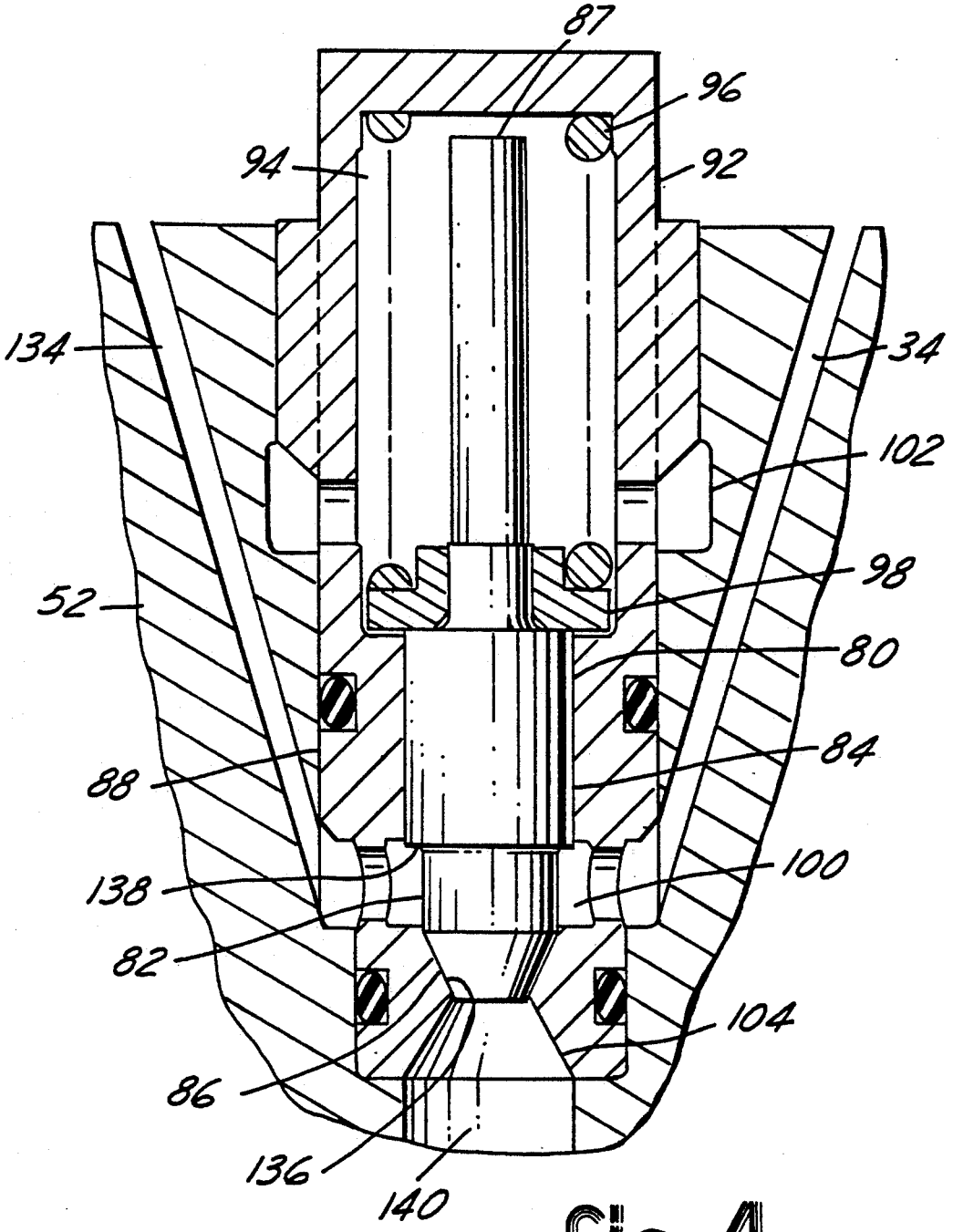
FIG. 4 is a side view of a discharge valve mounted within the inner piston, in accordance with the present invention.

FIG. 4 shows an enlarged cross-section of a discharge valve assembly. A valve portion 80 is installed inside a valve body 88 which is retained within the inner piston 52 by a retaining nut 92. Inside the retaining nut 92 is a spring chamber 94 containing a spring 96 which, through a spring seat 98 presses downward on the valve portion 80 biasing the valve assembly into its closed position. An annulus 100 surrounding the lower shank 82 of the valve portion 80 is connected to the upper oil chamber 58 via bores 134. The spring chamber 94 is connected to an annulus 102 which is vented into the crank case (not shown). A guiding cylinder 84 of the valve portion 80 fits into the valve body 88 with minimum clearance which prevents excessive oil leakage from the annulus 100 into the spring chamber 94. The force of the spring 96 tends to maintain the valve portion 80 in a normally closed position by keeping the conical tip 86 pressed against a corresponding valve seat 136 in the body 88. The force of the spring 96 is opposed by a valve opening force which includes a hydraulic pressure force acting on a ring-shaped surface 138 determined by the difference between the diameters of the guiding cylinder 84 and the lower shank 82; and an inertial force acting on the valve portion 80, spring 96, and spring seat 98. When the valve opening force exceeds the spring force, the valve portion 80 is lifted from the valve seat 136, and oil flows from the annulus 100 into the space between the conical tip 86 and valve outlet 104 and then through a discharge orifice 140. Once the valve portion 80 lifts, high pressure begins to act on the entire cross-sectional area of the valve portion 80 determined by the diameter of the guiding cylinder 84. This quickly moves the valve 80 through its entire stroke until the upper rod 87 hits the top of the retaining nut 92. As a result, closure of the valve portion 80 will not take place until the valve opening force drops to a value significantly smaller than what was required to open the valve. Both the primary and secondary discharge valves 66, 68 are of similar construction, but differ by the spring force, with the secondary discharge valve 68 having a higher spring pre-load.

The hydraulic system is calibrated to operate in three distinctly different modes of variable compression piston operation. The first is a steady-state dynamic equilibrium; the second is a transient increase in compression ratio and the third is a transient decrease in compression ratio.

The first mode of operation, steady-state dynamic equilibrium, takes place whenever the engine operates under constant load conditions. During each complete engine cycle, the net vertical force acting on the outer piston 50 continuously varies its magnitude and changes its direction at least twice. During the latter part of exhaust and early part of intake stroke, the inertial force acting upon the piston creates a substantial upward net vertical force. At that time, the outer piston 50 moves upward relative to the inner piston 52, and oil is transferred from the lower chamber 56 through the transfer valve 64 and the transfer orifice 74 into the upper chamber 58. Since the increase in the volume of the upper chamber 58 exceeds the decrease in the volume of the lower chamber 56, additional oil is supplied through the upper refill valve 70. The amount of upward travel of the outer piston is relatively small. It is controlled by the size of the two orifices 74, 106 which restrict the flow of oil to the upper chamber from the lower chamber and from the oil supply channel 118.

During the latter part of the intake stroke, the net vertical force reverses its direction to a downward one and, in most cases, retains this direction for the duration of the compression, expansion, and exhaust strokes. The downward net vertical force determines the oil pressure in the upper chamber 58 which contributes to the discharge valve opening force. Near the top dead center, this discharge force exceeds the spring force in the primary discharge valve 66. As a result, the valve opens and a certain quantity of oil is discharged from the upper chamber 58 through the primary discharge valve 66 and primary discharge orifice 76 into the crank case. The secondary discharge valve 68, which is set to open at a higher pressure, remains closed. Consequently, the outer piston moves downward relative to the inner piston while additional oil flows to the lower chamber through the lower refill valve 72. This motion continues until expansion of the gas in the engine cylinder reduces the pressure acting on the piston and the primary discharge valve 66 closes. The size of the primary discharge orifice 76 is calibrated such that the relative downward travel of the outer piston 50 is equal to the previously performed relative upward travel. This can also be accomplished using a different calibration for the primary discharge valve 66 rather than using the discharge orifice 76 to calibrate it. The relative up and down movement of the outer piston 50 is repeated every cycle and, therefore, the mean position of the outer piston 50 relative to the inner piston 52 remains the same, with the result that the compression ratio in the cylinder is constant.

Under constant load conditions, the compression ratio may still vary depending upon the engine speed. Since the discharge valve opening force is a function of both pressure and inertial forces, the compression ratio can be varied as a function of engine speed. A simplified equation for the valve opening force is:

$$F=P(_1A_1/A_3)A_2-M_1aA_3/A_2+M_3a\cos\Theta$$

Where:

F=the primary discharge valve 66 opening force, $P_1$=the pressure in the engine cylinder, $A_1$=the outer piston area on its upper surface, $A_2$=the inner piston area on its upper surface, $A_3$=the discharge valve pressure area, $M_1$=the mass of the outer piston 50, $M_3$=the mass of the valve portion 80 within the discharge valve, a=the acceleration of the reciprocating piston parallel with the cylinder axis 128, and Θ=angle between the movement of the valve portion 80 and the cylinder axis 128, the angle between 0° and 90°.

From the above equation, the following can be derived:

Firstly, if $(M_3/A_3)\cos\Theta=M_1/A_2$, then the valve opening force "F" is independent of the acceleration "a", thus, the compression ratio remains constant regardless of the engine speed;

Secondly, if $(M_3/A_3)\cos\Theta<M_1/A_2$, then the force "F" is decreasing with an increase in acceleration, thus, the compression ratio increases at increased engine speeds; and Thirdly, if $(M_3/A_3)\cos\Theta>M_1/A_2$, then the force "F" is increasing with an increase in acceleration, thus, the compression ratio decreases at increased engine speeds.

Therefore, depending upon the selection of the discharge valve mass "$M_3$", its pressure area "$A_3$", and its angle relative to the cylinder axis "Θ", the compression ratio can be an increasing or decreasing function of engine speed. It can also be independent of speed. The configuration shown in FIG. 3 has the primary discharge valve 66 oriented with Θ=0.

The second mode of operation, transient increase in compression ratio, takes place whenever the engine load decreases. When the engine load decreases, there is a drop in peak cylinder pressure and the discharge valve opening force remains below the spring force, so the primary discharge valve 66 remains closed. As a result, the relative upward travel of the outer piston 50 is not compensated by a corresponding relative downward travel. Each cycle, the outer piston 50 moves a small increment upward relative to the inner piston 52, consequently increasing the compression ratio. When the peak cylinder pressure increases to the predetermined level for which the primary discharge valve 66 was calibrated, the primary discharge valve 66 begins to open again, and a new state of dynamic equilibrium is established. The engine load is lower, but the compression ratio increases to maintain the maximum predetermined allowable peak pressure and temperature.

The third mode of operation, transient decrease in compression ratio, takes place whenever the engine load increases. When the engine load increases, there is an increase in cylinder pressure so that the discharge valve opening force increases to a level at which both the primary and secondary discharge valves 66, 68 open. With both discharge valves 66, 68 discharging oil from the upper chamber 58, the relative downward travel of the outer piston 50 during each cycle engine is significantly larger than its upward travel. As a result, each cycle the outer piston 50 moves a certain increment downward relative to the inner piston 52, thus decreasing the compression ratio. The rate of compression ratio decrease is determined by the size of the secondary discharge orifice 78. When the cylinder pressure decreases to the predetermined level for which the secondary discharge valve 68 was calibrated, the secondary discharge valve stops opening and a new state of dynamic equilibrium is established. The engine load is higher, but the compression ratio is reduced to maintain the peak predetermined pressure and temperature within the maximum allowable range.

Figure 5:
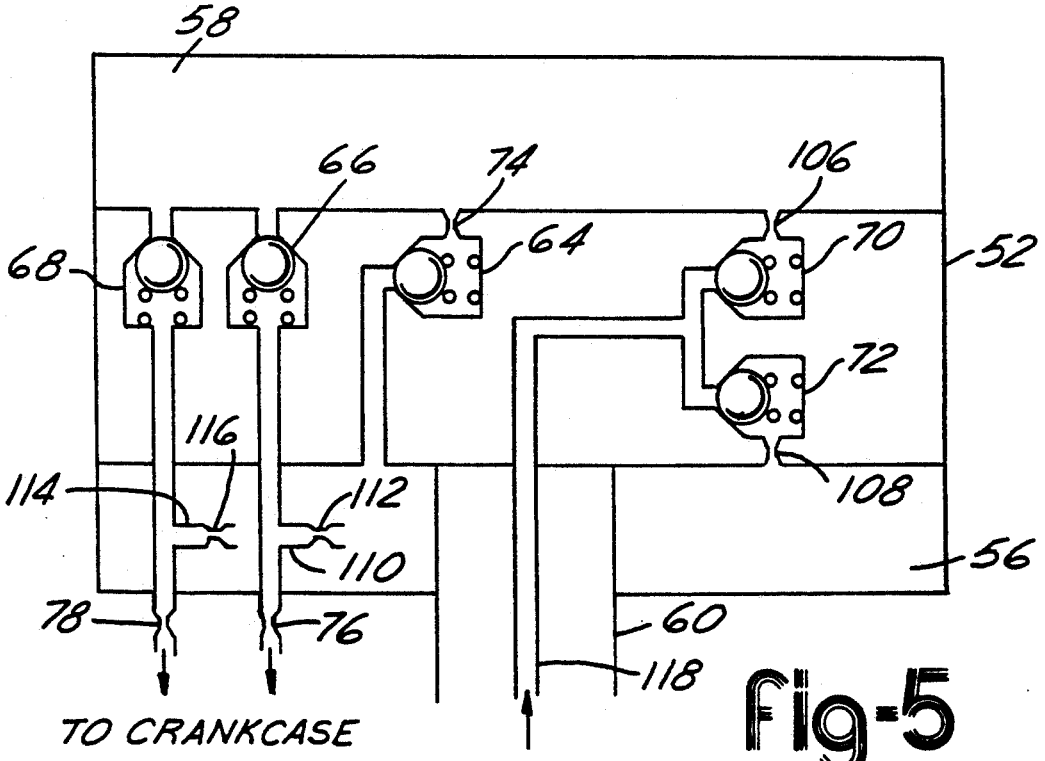
FIG. 5 is a schematic diagram similar to FIG. 3, showing an alternative embodiment of the present invention.

During the discharge of oil from the upper chamber 58 through the discharge valves 66, 68, the volume of the lower chamber 56 expands and is refilled with oil flowing through the lower refill valve 72 and orifice 108. In some cases, the rate of volume expansion may exceed the refill capacity of the valve 72 and orifice 108, and the pressure in the lower oil chamber 56 may temporarily drop to a level significantly below atmospheric pressure. This may cause oil vapor formation and cavitation in the lower oil chamber 56. To prevent the possibility of oil vapor formation and cavitation the space between the primary discharge valve 66 and the primary discharge orifice 76 may be connected to the lower chamber 56 through a passage 110 and a compensating orifice 112, as illustrated in the alternative embodiment shown in FIG. 5. Likewise, the space between the secondary discharge valve 68 and the secondary discharge orifice 78 may be connected to the lower chamber 56 through a passage 114 and a compensating orifice 116. In this embodiment, some of the discharged oil flows into the lower oil chamber 56 to prevent vapor formation and cavitation. The size of the compensating orifices 112 and 114 are selected so that during the discharge from the upper oil chamber 58, the pressure in the lower oil chamber 56 remains above atmospheric pressure.

Figure 6:
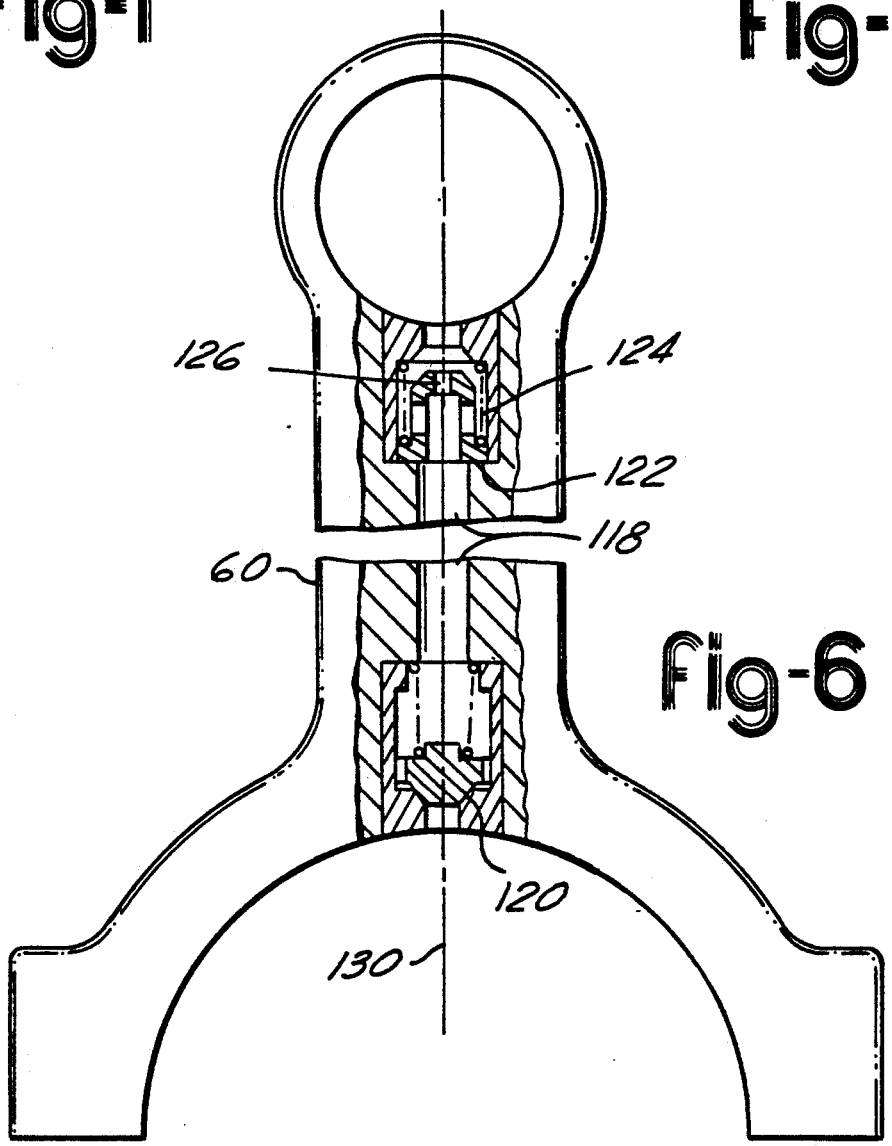
FIG. 6 is a schematic diagram of valves mounted within the connecting rod, in accordance with the present invention.

A further aspect of the preferred embodiment is shown in FIG. 6. The oil in the oil supply channel 118 within the connecting rod 60 is subjected to inertial forces due to the reciprocating motion of the piston. At high engine speeds, these inertial forces can lead to a reverse flow of oil from the channel oil supply 118 when the piston is near the bottom dead center. This creates a problem if the oil drains out of the oil supply channel 118. Also, at high engine speeds, these inertial forces can lead to excessively high supply pressure when the piston is near the top dead center. This creates a problem if the oil pressure in the oil supply channel 118 is too high. To prevent an outflow of oil from the connecting rod when the piston is near the bottom dead center, a normally closed, pressure-actuated one-way valve 120 may be installed at the entrance to the channel 118. This one-way valve 120 will then prevent the oil from draining out of the oil supply channel 118. The excessively high supply pressure, on the other hand, can be prevented by installing a normally open inertial force actuated snubber valve 122 into the system. Such a valve can be installed in various locations, such as at the top of the connecting rod 60, in the piston pin 62, or in the inner piston 52. FIG. 6 shows a snubber valve installation 122 at the outlet from the oil supply channel 118. Whenever the inertial force acting on the snubber valve 122 exceeds the pre-load of the snubber valve spring 124, the snubber valve 122 closes and the flow of oil is restricted by the snubber valve orifice 126 which prevents excessive oil supply pressure from reaching the piston.

We claim:

1. A variable compression piston adapted for use with an internal combustion engine and to be pivotally connected to an engine connecting rod with an oil supply channel extending through the engine connecting rod, the variable compression piston comprising:

an outer piston;

an inner piston concentrically slidably nested within the outer piston and forming an upper oil chamber therebetween and having a central axis;

a bottom plate fixed to the outer piston at a point below the inner piston and forming a lower oil chamber between the inner piston and the bottom plate; and an oil filled hydraulic system including a one way transfer valve for transferring the oil from the lower chamber to the upper chamber when the oil pressure in the lower chamber exceeds the oil pressure in the upper chamber by a predetermined amount;

the hydraulic system further including discharge valve means for discharging oil from the upper oil chamber when the compression ratio of the cylinder reaches a predetermined amount, and supply valve means for supplying the upper and lower chambers with oil by communicating with the connecting rod supply channel.

2. The invention of claim 1 wherein the discharge valve means is comprised of a primary valve means for discharging from the upper oil chamber an amount each cycle of the piston which maintains a constant compression ratio, and thereby maintaining the relative positions of the outer and inner pistons for a substantially constant engine load; and the discharge valve means further including a secondary valve means for discharging additional oil from the upper chamber when the engine load increases and causes a resultant increase in the upper oil chamber pressure, thereby making the outer piston move downward relative to the inner piston until reaching the desired predetermined compression ratio.

3. The invention of claim 1 wherein the supply valve means is comprised of an upper supply valve having a one way valve and calibrated to open at a low oil pressure differential allowing oil to enter the upper oil chamber when the oil pressure in the oil supply channel is greater than the oil pressure in the upper oil chamber, and a lower supply valve having a one way valve and calibrated to open at a low oil pressure differential allowing oil to enter the lower oil chamber when the oil pressure in the oil supply channel is greater than the oil pressure in the lower oil chamber.

4. The invention of claim 3 wherein the one way transfer valve and the upper and lower supply valves are mounted normal to the piston central axis to eliminate inertia effects associated with the reciprocating motion of the piston.

5. The invention of claim 1 wherein the discharge valve means includes at least one one-way discharge valve having a valve body retained within the inner piston with a spring chamber and an annulus within the periphery;

a valve portion mounted within the valve body having a spring seat; and a spring mounted within the spring chamber pressing against the spring seat which biases the valve in the closed position;

the valve portion including a cylindrical guiding cylinder slidably engaging the valve body and butting against the spring seat; a conical tip which seats against the outlet of the valve body; and a lower shank portion therebetween of a smaller diameter than the guiding cylinder and located adjacent to the annulus in the valve body when the valve is in its closed position;

the discharge valve calibrated according to the following equation:

$$F=P_1(A_1/A_2)A_3-M_1aA_3/A_2+M_3a\cos\Theta,$$

where $F$=The primary discharge valve opening force, $P_1$=The pressure in the engine cylinder, $A_1$=The outer piston area on its upper surface, $A_2$=The inner piston area on its upper surface, $A_3$=The discharge valve pressure area, $M_1$=The mass of the outer piston, $M_3$=The mass of the valve portion within the discharge valve, $a$=The acceleration of the piston parallel with the piston axis, and $\Theta$=the angle between the movement of the valve portion and the cylinder axis, the angle between 0 and 90 degrees; and wherein the valve is calibrated such that $(M_3A_3)\cos\Theta<M_1/A_2$ will produce a compression ratio which increases with increasing engine speed, and $(M_3/A_3)\cos\Theta>M_1/A_2$ produces a compression ratio which decreases with increasing engine speed.

6. In an internal combustion engine having a variable compression piston slidably installed within an engine cylinder and pivotally connected to an engine connecting rod with an oil supply channel located along the engine connecting rod longitudinal axis, the variable compression piston comprising:

an outer piston;

an inner piston concentrically slidably nested within the outer piston and forming an upper oil chamber therebetween and having a central axis;

a bottom plate fixed to the outer piston at a point below the inner piston and forming a lower oil chamber between the inner piston and the bottom plate;

an oil filled hydraulic system including transfer valve means for transferring the oil between the lower chamber and the upper chamber and supply means for supplying the upper and lower chambers with oil by communicating with the connecting rod supply channel; and the hydraulic system further including primary valve means for discharging oil from the upper oil chamber an amount each cycle maintain a constant compression ratio, by maintaining the relative position of the outer and inner pistons, for a constant engine load; and secondary valve means which discharges additional oil from the upper chamber, whenever the engine load increases causing a resultant increase in the compression ratio, thereby moving the outer piston downward relative to the inner piston until again reaching the desired compression ratio.

7. The invention of claim 6 wherein the transfer means is comprised of a one way transfer valve mounted normal to the inner piston central axis within the inner piston which transfers oil from the lower chamber to the upper chamber when the oil pressure in the lower chamber exceeds that in the upper chamber by a predetermined amount.

8. The invention of claim 6 wherein the supply means is comprised of a one-way upper supply valve calibrated to open at a low oil pressure differential allowing oil to enter the upper oil chamber when the oil pressure in the oil supply channel is greater than the oil pressure in the upper oil chamber, and a one-way lower supply valve calibrated to open at a low oil pressure differential allowing oil to enter the lower oil chamber when the oil pressure in the oil supply channel is greater than the oil pressure in the lower oil chamber; the two supply valves mounted normal to the piston central axis to eliminate inertia effects associated with the reciprocating motion of the piston.

9. The invention of claim 6 wherein the oil supply channel within the engine connecting rod contains a valve calibrated to restrict the flow of oil through the oil supply channel when a predetermined threshold value of oil pressure is reached within the oil supply channel thereby limiting the pressure that oil flowing into the supply means will attain.

10. The invention of claim 6 wherein the primary valve means is comprised of a one way discharge valve mounted within a primary discharge bore through the inner piston, which allows oil to discharge from the upper oil chamber into a crank case, and the secondary means is comprised of a one way discharge valve mounted within a secondary valve discharge bore which allows the oil to discharge from the upper oil chamber to the crankcase.

11. The invention of claim wherein the primary valve means and secondary valve means are each comprised of a one way valve mounted within a corresponding discharge bore through the inner piston which allows the oil to discharge into both the lower oil chamber and a crankcase.

12. In combination with a reciprocating variable compression piston assembly, a valve assembly located within a bore extending through the piston assembly for allowing fluid to flow from one side of the piston to the other when the valve assembly is open, the valve assembly comprising:

a valve body retained within the piston assembly having a spring chamber and an annulus within the periphery;

a valve portion mounted within the valve body having a spring seat;

a spring mounted within the spring chamber pressing against the spring seat which biases the valve in the closed position;

the valve portion including a cylindrical guiding cylinder slidably engaging the valve body with virtually no clearance therebetween and butting against the spring seat; a conical tip which seats against the outlet of the valve body; and a lower shank portion therebetween of a slightly smaller diameter than the guiding cylinder and located adjacent to the annulus in the valve body when the valve is in its closed position;

the discharge valve calibrated according to the following equation:

$$F=P_1(A_1/A_2)A_3-M_1aA_3/A_2+M_3a\cos\Theta,$$

where $F$=The primary discharge valve opening force, $P_1$=The pressure in the engine cylinder, $A_1$=The outer piston area on its upper surface, $A_2$=The inner piston area on its upper surface, $A_3$=The discharge valve pressure area, $M_1$=The mass of the outer piston, $M_3$=The mass of the valve portion within the discharge valve, $a$=The acceleration of the piston parallel with the piston axis, and $\Theta$=The angle between the movement of the valve portion and the cylinder axis, the angle between 0 and 90 degrees; and wherein the valve is calibrated such that $(M_3/A_3)\cos\Theta<M_1/A_2$ will produce a compression ratio which increases with increasing engine speed, and $(M_3/A_3)\cos\Theta>M_1/A_2$ produces a compression ratio which decreases with increasing engine speed.

13. In an internal combustion engine having a variable compression piston assembly slidably installed within an engine cylinder and pivotally connected to an engine connecting rod with an oil supply channel located along the engine connecting rod longitudinal axis, the variable compression piston comprising:

an outer piston;

an inner piston concentrically slidably nested within the outer piston and forming an upper oil chamber therebetween and having a central axis;

a bottom plate fixed to the outer piston at a point below the inner piston and forming a lower oil chamber between the inner piston and the bottom plate;

hydraulic system means for transferring oil between the lower chamber and the upper chamber, discharge means for discharging from the upper oil chamber when the compression ratio of the cylinder reaches a predetermined amount, and supply means for supplying the upper and lower chamber with oil by communicating with the connecting rod supply channel;

a one-way stop valve located within the engine connecting rod along the oil supply channel calibrated to close off the oil supply channel when a predetermined maximum threshold of oil pressure is reached within the oil supply channel thereby limiting the amount of pressure than the oil flowing to the supply means will attain; and a second one way valve located within the engine connecting rod along the oil supply channel calibrated to restrict the flow of oil when the oil flow direction in the oil supply channel is downward to prevent the oil from emptying out of the oil supply channel.

* * * * *